United States Patent [19]

Pieczykolan

[11] Patent Number: 4,648,459

[45] Date of Patent: Mar. 10, 1987

[54] LOW PRELOAD SELF-SEALING QUICK RELEASE VALVE FOR SPRINKLER HEAD

[75] Inventor: George S. Pieczykolan, North Wales, Pa.

[73] Assignee: Central Sprinkler Corporation, Lansdale, Pa.

[21] Appl. No.: 793,030

[22] Filed: Oct. 30, 1985

[51] Int. Cl.[4] ..... A62C 37/14

[52] U.S. Cl. ..... 169/38

[58] Field of Search ..... 169/37–42, 169/19, 90; 137/72, 74, 79

[56] References Cited

U.S. PATENT DOCUMENTS 3,918,645 11/1975 Mohler ..... 169/37 X 4,217,961 8/1980 Wotten ..... 169/41

*Primary Examiner*—Jeffrey V. Nase

*Attorney, Agent, or Firm*—Seidel, Gonda, Goldhammer & Abbott

[57] ABSTRACT

Quick release valve for a sprinkler head having a frame adapted to support a thermal responsive actuating element. The quick release valve includes a saddle adapted to contact an end of the actuating element, a bushing having a first surface portion adapted to face the flow passage wall of the frame and a second surface portion adapted to face the saddle, an O-ring for sealing the interface between the flow passage wall and the bushing first surface portion, and another O-ring for sealing the interface between the saddle and the bushing second surface portion. The bushing is axially displaceable within the flow passage. A split retaining ring is insertable in the flow passage to axially displace the bushing so as to exert a compressive preload on the actuating element.

9 Claims, 3 Drawing Figures

LOW PRELOAD SELF-SEALING QUICK RELEASE VALVE FOR SPRINKLER HEAD

BACKGROUND OF THE INVENTION

The invention is directed to a quick release valve for a sprinkler head wherein a thermal responsive actuating element such as a frangible bulb, link, lever, fusible alloy strut or the like is used as the triggering element. The sprinkler head is coupled to a conduit which provides a pressurized fluid, such as water for extinguishing a fire.

A sprinkler head wherein the compressive preload on the thermal responsive element is reduced without substantially compromising the valve seal is disclosed in U.S. Pat. No. 4,167,974 (Job). The temperature responsive element is a frangible bulb mounted between the head body and a preloaded Belleville washer mounted on the valve seat. The preloaded washer flexes to accommodate fluid pressures experienced during normal operation.

A quick release valve for a sprinkler head wherein the compressive preload on a frangible bulb is substantially reduced is disclosed in co-pending patent application Ser. No. 722,084 filed Apr. 11, 1985 in the name of the inventor herein and assigned to the same assignee. Reduction of the compressive preload allows lightweight and thinner walled frangible bulbs to be employed so as to provide a quicker response or triggering action without compromising the frangible bulb or the valve seal.

The problem solved by the present invention is that of providing a self-sealing quick release valve for a sprinkler head which exerts minimal compressive preload and load on the thermal responsive actuating element whereby the element as well as the sprinkler head frame can be made thinner and lightweight without compromising the integrity of the element or the valve seal and the conventional set screw for compressive preload can be eliminated.

BRIEF SUMMARY OF THE INVENTION

A quick release valve for a sprinkler head having a frame adapted to support a thermal responsive actuating element at one end, and a flow passage defined by a flow passage wall, comprises a saddle adapted to contact another end of the thermal responsive actuating element, and a bushing having a first surface portion adapted to face the flow passage wall and a second surface portion adapted to face the saddle. First and second sealing means which are resiliently deformable by the bushing surface portions seal the interfaces between the bushing and the flow passage wall and between the bushing and the saddle. The bushing is axially displaceable within the flow passage so as to exert a compressive preload on the thermal responsive element.

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
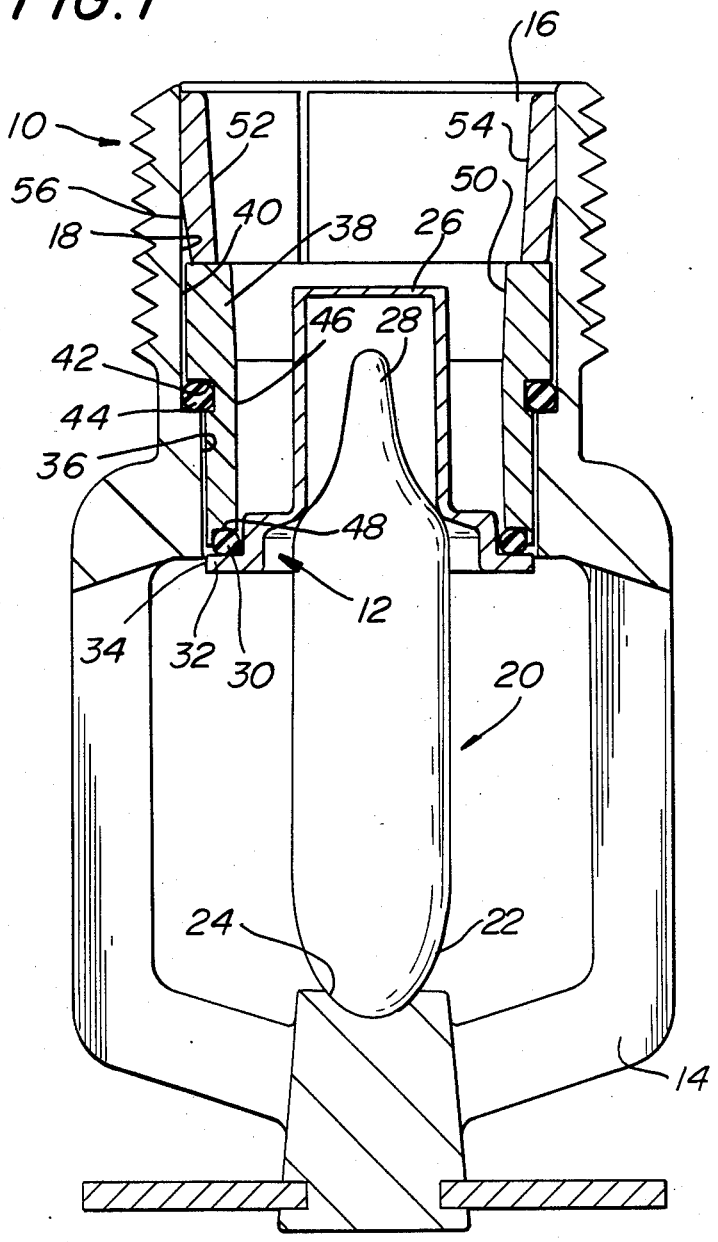
FIG. 1 is a partial section of a sprinkler head showing the quick release valve of the present invention under compressive preload.

Referring to the drawings, wherein like numerals indicate like elements, there is shown in FIG. 1 a sprinkler head generally designated as 10 equipped with a quick release valve 12 according to the present invention. The sprinkler head includes a frame 14 and a generally circular flow passage 16 defined by a passage wall 18. As is well-known, the sprinkler head frame is threaded so as to couple the flow passage 16 to a pressurized fluid source. Pressurized fluid, typically water, enters the flow passage during normal operation as indicated by the arrows in FIG. 1. Before pressurized fluid is admitted to the flow passage, the valve 12 is subjected to a compressive preload, the valve assuming the configuration generally shown in FIG. 1.

A thermal responsive actuating element 20 is supported at one end 22 by the frame 14, the end 22 being seated in a detent or depression 24 formed in the frame. The valve 12 includes a cup-shaped saddle 26 made of a rigid material, for example brass or copper coated with a Teflon (Trademark) material which resists adhesion. The saddle is mounted on an end 28 of the element 20. A resilient O-ring seal 30 is mounted on the saddle above an annular flange 32. O-ring seal 30 may be made of a neoprene or Teflon (Trademark) material. The peripheral edge 34 of the saddle flange is spaced from the passage wall 18 proximal a circular lip 36.

Valve 12 also includes a bushing 38 having a generally cylindrical shape with an outer surface 40 which is stepped so as to define an annular shoulder 42. The bushing 38 is preferably brass or copper. An O-ring seal 44 is mounted on the bushing at shoulder 42. The O-ring seal 44 may be made of the same material as seal 30. The shoulder 42 faces passage wall 18 and is spaced from lip 36 by seal 44. The bushing also includes an inner surface 46 which is stepped so as to define a shoulder 48. Surface 46 is also provided with a conical surface portion 50 which serves as a reaction surface so as to insure proper displacement of the bushing 38 when subjected to fluid pressure under normal load conditions. The outer diameter of bushing 38 along surface 40 is such that a slight clearance is created between surface 40 and the passage wall 18 (including lip 36). Accordingly, the bushing is axially and laterally displaceable within the flow passage. Lateral displacement of the bushing under normal load conditions permits the bushing to wipe or shear off any encrustations on lip 36.

Figure 2:
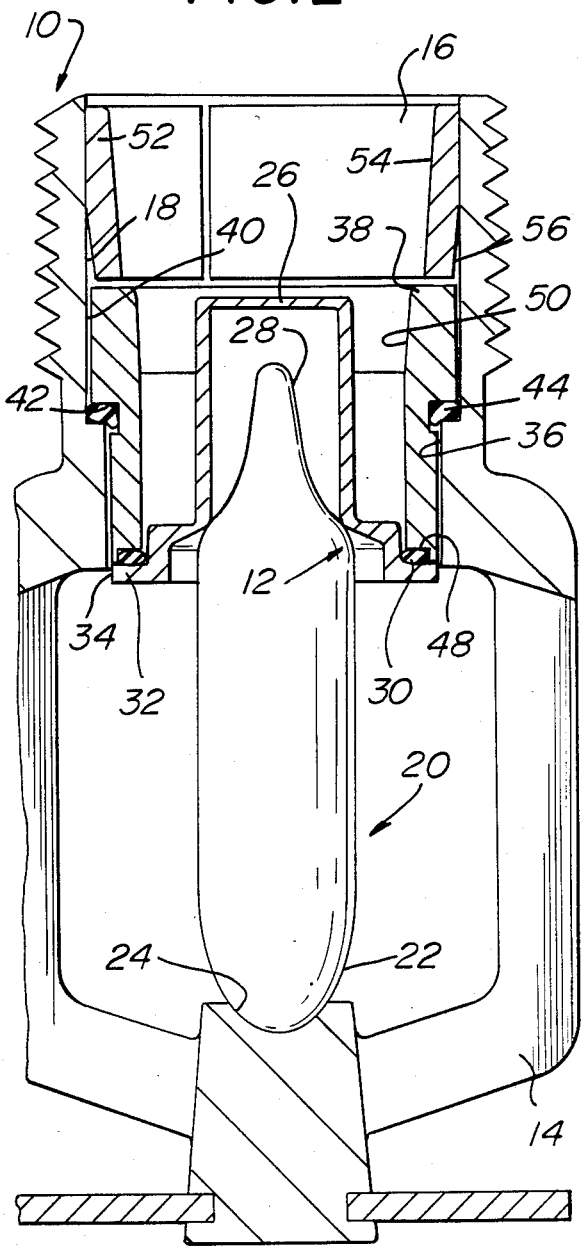
FIG. 2 is a partial section of a sprinkler head showing the quick release valve of the present invention under compressive load during normal operation.
Figure 3:
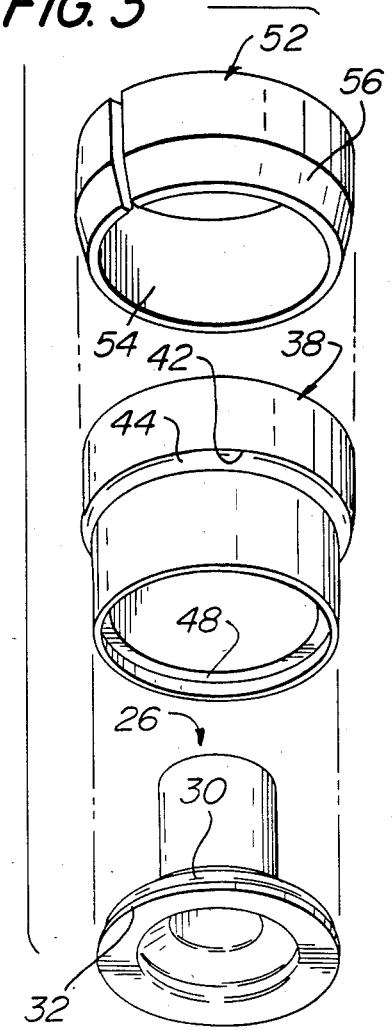
FIG. 3 is an exploded isometric of the quick release valve.

Preferably, the diameters of the cross sections of O-ring seals 30 and 44 are different, the diameter of the cross section of O-ring 44 being greater than the diameter of the cross section of O-ring 30. It is preferred that the diameter of the cross section of O-ring seal 44 be 0.070 inch or larger and that the diameter of the cross section of O-ring seal 30 be 0.040 inch or smaller. By reducing the cross-section of O-ring seal 30, the effect of long term adhesion at the seal contact surface can be minimized. The annular shoulders 42, 48 are sized so that their surface areas accomodate the associated O-ring seals. Assuming a surface area at shoulder 42 of 0.30 square inches, a surface area at shoulder 48 of 0.15 square inches, and a nominal fluid pressure of 100 psi under normal load conditions, bushing 38 would tend to experience a compressive load of 30 pounds at shoulder 42 and a compressive load of 15 pounds at shoulder 48. The compressive load acting on the bushing will displace the bushing axially so as to squeeze O-rings 30, 44 and seal the interface between the passage wall and the bushing as well as the interface between the bushing and the saddle. See FIG. 2. Since the saddle is mounted on thermal responsive actuating element 20, which is rigid, the actual compressive load on the thermal responsive element will be 30 pounds. Thus, in the present invention, the compressive load on element 20 is minimal under normal fluid pressure conditions.

Conventional sprinkler heads provide a compressive preload for the temperature responsive actuating element by means of a set screw located in the sprinkler head frame. In the present invention, the compressive preload is exerted by a split retaining ring 52 which, when expanded, has an outer diameter slightly greater than the inner diameter of the passage wall. Accordingly, when inserted in the flow passage, the ring outer surface frictionally engages passage wall 18 so as to retain the ring in the desired position. The split ring 52 is inserted in the flow passage so as to abut the bushing 38 and exert an axial load on the bushing whereby the bushing deforms O-ring seals 30, 44 and exerts a slight compressive preload, say 10 pounds or less, on thermal responsive element 20. The split ring may be provided with a tapered inner surface 54 so as to provide for stable, laminar flow of the pressurized fluid as it enters the flow passage. The ring may also be provided with a slight taper 56 on its outer surface so as to provide a pilot surface for insertion of the ring in the flow passage.

Compressive preload in the present invention is obtained without any rotation or torquing of element 20. Conventional mechanisms utilize a set screw on the sprinkler head frame to exert the compressive preload, and rotation of the set screw can rotate element 20. An imperfection in the saddle at the point of contact with element 20 can, under such conditions, scribe the element wall, thereby weakening the wall. The possibility of scribing and weakening the element wall is entirely eliminated in the present invention since the entire preload is compressive, there being no torque component and no set screw.

Assembly of the quick release valve of the present invention in the sprinkler head is particularly suited for automation on a mass production line. The valve comprises a minimum of components which are all easily assembled in the flow passage. Since the compressive preload, as well as the compressive load under normal fluid pressure conditions, are substantially reduced, the thermal responsive actuating element and the sprinkler head frame may be made relatively thin and light weight with attendant reductions in the cost of manufacture.

The present invention may be embodied in other specific forms without departing from the spirit or essential attributes thereof and, accordingly, reference should be made to the appended claims, rather than to the foregoing specification, as indicating the scope of the invention.

I claim:

1. A quick release valve for a sprinkler head having a frame adapted to support a thermal responsive actuating element at one end, and a flow passage defined by a flow passage wall, comprising:

a saddle adapted to contact another end of the thermal responsive actuating element, a bushing having a first surface portion adapted to face the flow passage wall and a second surface portion adapted to face the saddle, first sealing means resiliently deformable by the bushing first surface portion for sealing the interface between the flow passage wall and the bushing first surface portion, second sealing means resiliently deformable by the bushing second surface portion for sealing the interface between the saddle and the bushing second surface portion, said bushing being axially displaceable within the flow passage, and means for axially displacing said bushing in the flow passage so as to exert a compressive preload on the thermal responsive actuating element.

2. Quick release valve according to claim 1 wherein said first sealing means includes a first O-ring, and said second sealing means includes a second O-ring, the cross-section of said first O-ring being larger than that of said second O-ring.

3. Quick release valve according to claim 2 wherein the diameter of the cross section of said first O-ring is 0.070 inch or larger and the diameter of the cross-section of said second O-ring is 0.040 inch or smaller.

4. Quick release valve according to claim 1 wherein said means for axially displacing said bushing includes a split retaining ring adapted to frictionally engage passage wall.

5. Quick release valve according to claim 1 wherein the thermal responsive actuating element is a frangible bulb.

6. Quick release valve for a sprinkler head having a frame adapted to support a thermal responsive actuating element at one end, and a flow passage defined by a flow passage wall, comprising:

a saddle adapted to contact another end of said thermal responsive actuating element, a bushing having an outer diameter less than the inner diameter of the passage wall so as to provide a clearance therebetween whereby the bushing is axially displaceable within the flow passage, said passage wall being provided with a lip, said bushing including an outer shoulder adapted to face said passage wall and said lip, and an inner shoulder adapted to face said saddle, a first resilient seal mounted on said bushing outer shoulder, and a second resilient seal mounted on said saddle so as to face said bushing inner shoulder, said first resilient seal having a larger cross-sectional area than that of said second resilient seal, and means for axially displacing said bushing in the flow passage so as to exert a compressive preload on the thermal responsive actuating element.

7. Quick release valve according to claim 6 wherein said first resilient seal includes a first O-ring, and said second resilient seal includes a second O-ring.

8. Quick release valve according to claim 7 wherein the diameter of the cross-section of said first O-ring is 0.070 inch or larger and the diameter of the cross-section of said second O-ring is 0.040 inch or less.

9. Quick release valve according to claim 7 wherein said means for axially displacing said bushing includes a split retaining ring adapted to frictionally engage said passage wall.

* * * * *